US010946405B2

(12) United States Patent
McAfee et al.

(10) Patent No.: US 10,946,405 B2
(45) Date of Patent: Mar. 16, 2021

(54) TURF SYSTEM FOR SPRINKLERS

(71) Applicant: Rain Bird Corporation, Azusa, CA (US)

(72) Inventors: Michael A. McAfee, Tucson, AZ (US); Daniel Roger St. George, Vail, AZ (US); Matthew Nugent Christensen, Tucson, AZ (US)

(73) Assignee: Rain Bird Corporation, Azusa, CA (US)

( * ) Notice: Subject to any disclaimer, the term of this patent is extended or adjusted under 35 U.S.C. 154(b) by 0 days.

(21) Appl. No.: 16/132,864

(22) Filed: Sep. 17, 2018

(65) Prior Publication Data

US 2019/0105681 A1 Apr. 11, 2019

Related U.S. Application Data

(60) Provisional application No. 62/570,025, filed on Oct. 9, 2017, provisional application No. 62/570,085, filed on Oct. 9, 2017.

(51) Int. Cl.

| | |
|---|---|
| ***B05B 15/74*** | (2018.01) |
| ***B05B 3/04*** | (2006.01) |
| ***B05B 15/16*** | (2018.01) |
| *B05B 1/30* | (2006.01) |

(52) U.S. Cl.

CPC ..... *B05B 15/74* (2018.02); *B05B 3/0472* (2013.01); *B05B 15/16* (2018.02); *B05B 1/3026* (2013.01); *B05B 3/0431* (2013.01); *B05B 3/0486* (2013.01)

(58) Field of Classification Search

CPC ..... B05B 15/16; B05B 15/70; B05B 15/74; B05B 3/0472; B05B 3/0431; B05B 3/0486; B05B 1/3026

USPC ..... 239/203–206, 288–298, 201

See application file for complete search history.

(56) References Cited

U.S. PATENT DOCUMENTS

| | | | | |
|---|---|---|---|---|
| 1,605,242 A | | 11/1926 | Keys | |
| 3,709,435 A | * | 1/1973 | Sheets | B05B 15/74 239/206 |
| 3,921,911 A | | 11/1975 | Sheets | |
| 4,010,901 A | | 3/1977 | Sheets | |
| 4,014,502 A | * | 3/1977 | Sheets | B05B 7/2462 239/206 |
| 4,113,181 A | | 9/1978 | Sheets | |

(Continued)

OTHER PUBLICATIONS

Photographs of Rain Bird Corporation 8005 Sod Cup Product, available more than one year before the filed, 39 pages.

(Continued)

*Primary Examiner* — Steven J Ganey

(74) *Attorney, Agent, or Firm* — Fitch, Even, Tabin & Flannery, LLP

(57) ABSTRACT

There is provided a turf cup assembly that attaches to a buried pop-up type sprinkler to blend a top of sprinkler both cosmetically and functionally with turf surrounding the sprinkler. The turf cup assembly includes a turf cup and a sleeve. The turf cup mounts to a riser of the pop-up type sprinkler. The turf cup contains soil and root structure of turf. The sleeve surrounds the turf cup and attaches to a top of a housing of a pop-up sprinkler. The sleeve can be at or slightly below grade, and the cup extends out of the sleeve during an irrigation cycle and retracts into the sleeve at the end of the irrigation cycle.

13 Claims, 18 Drawing Sheets

(56) References Cited

U.S. PATENT DOCUMENTS

| | | | | |
|---|---|---|---|---|
| 4,429,832 | A * | 2/1984 | Sheets | B05B 15/74 239/204 |
| 6,439,476 | B1 * | 8/2002 | Boggs | B05B 15/16 239/203 |
| 6,805,203 | B2 | 10/2004 | Retzloff | |
| 7,540,330 | B2 | 6/2009 | Orr | |
| D660,401 | S | 5/2012 | Dolan | |
| 8,220,556 | B2 | 7/2012 | Retzloff | |
| 8,469,111 | B2 | 6/2013 | Orr | |
| 8,616,467 | B1 | 12/2013 | Leavitt | |
| 8,695,719 | B2 | 4/2014 | Retzloff | |
| 8,910,723 | B2 | 12/2014 | Orr | |
| D721,418 | S | 1/2015 | Koiwa | |
| D721,419 | S | 1/2015 | Koiwa | |
| 9,993,674 | B2 | 6/2018 | Retzloff | |
| 10,314,245 | B2 * | 6/2019 | Wright, III | A01G 20/00 |
| 10,702,883 | B2 | 7/2020 | Anuskiewicz | |
| 2017/0223905 | A1 * | 8/2017 | Wright, III | B05B 15/16 |

OTHER PUBLICATIONS

Rain Bird Corporation, excerpts from Rain Bird Landscape Irrigation Products 2011/2012 Catalog, Dec. 10, 2011, 4 pages.
Rain Bird Corporation, Rain Bird 8005 Sod Cup Installation Guide, Sep. 6, 2006, 2 pages.

* cited by examiner

TURF SYSTEM FOR SPRINKLERS

CROSS-REFERENCE TO RELATED APPLICATIONS

This application claims benefit of U.S. Provisional Application No. 62/570,085, filed Oct. 9, 2017, and Provisional Application No. 62/570,025, filed Oct. 9, 2017, which are hereby incorporated herein by reference in their entirety.

FIELD

The present invention pertains to the blending of irrigation sprinklers in with their surroundings and, more particularly, to being able to include turf on the top of pop-up sprinklers so that when they are retracted they blend in with the turf surrounding them both cosmetically and functionally.

BACKGROUND

Irrigation systems can be designed with underground conduit and buried sprinklers that pop up during irrigation cycles and retract after irrigation cycles. The tops of the sprinklers when retracted are at or slightly below grade. However, they are noticeable and can be stepped on or tripped over while walking or running. There are instances (e.g., with athletic fields, recreation areas and golf courses) where it is desirable to have turf cover the tops of the sprinklers. This disguises the tops to provide a better appearance and enables one to walk or run over the tops with a reduced chance of tripping on the sprinkler. It also enhances the function of the turf during sports when a ball or other implement of a game bounces or rolls over the sprinkler. For instance, it will function more like actual turf if a golf ball hits on the turf covering the sprinkler.

DETAILED DESCRIPTION

Figure 1:
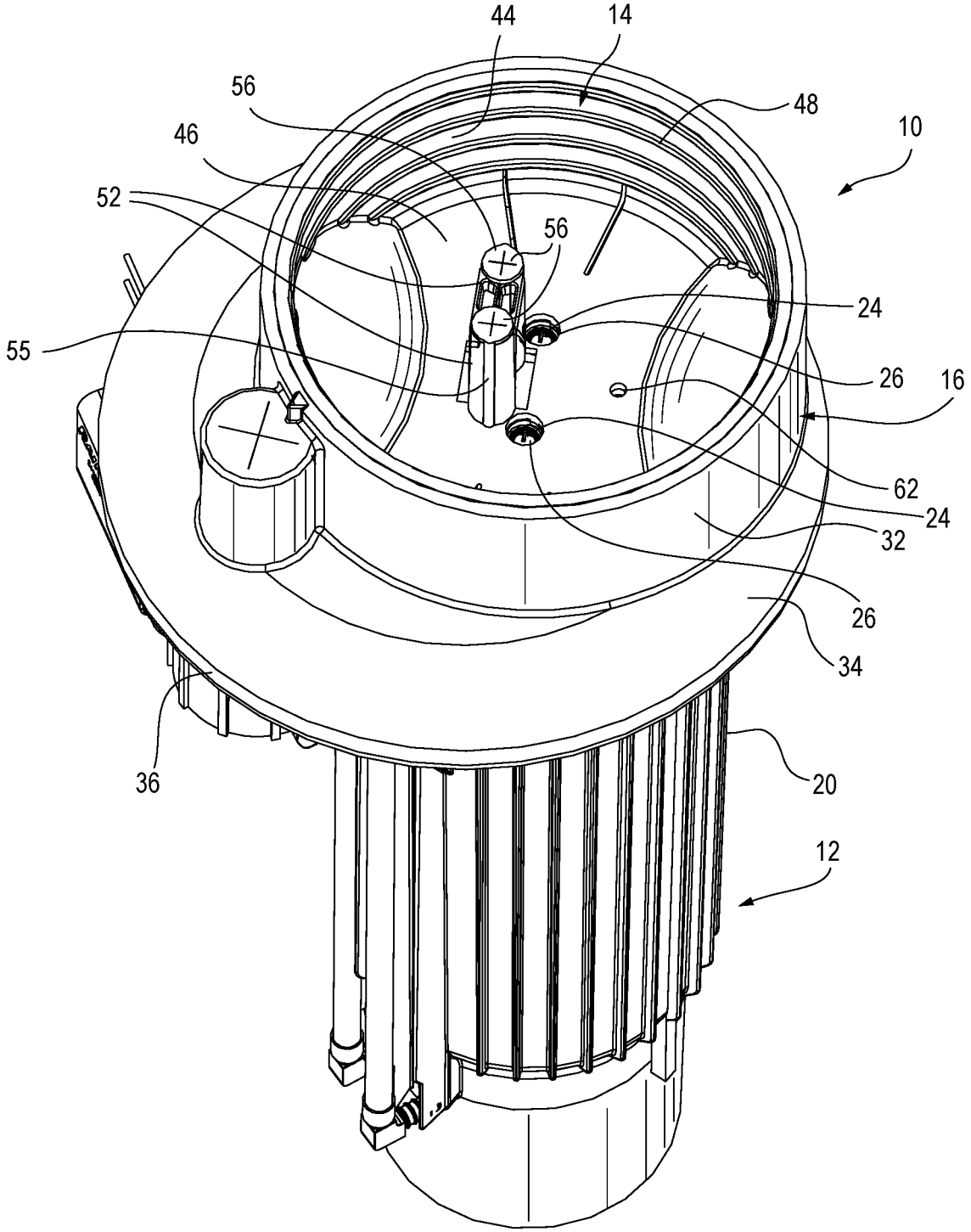
FIG. 1 is a top perspective view a turf cup assembly attached to a top of a sprinkler.
Figure 2:
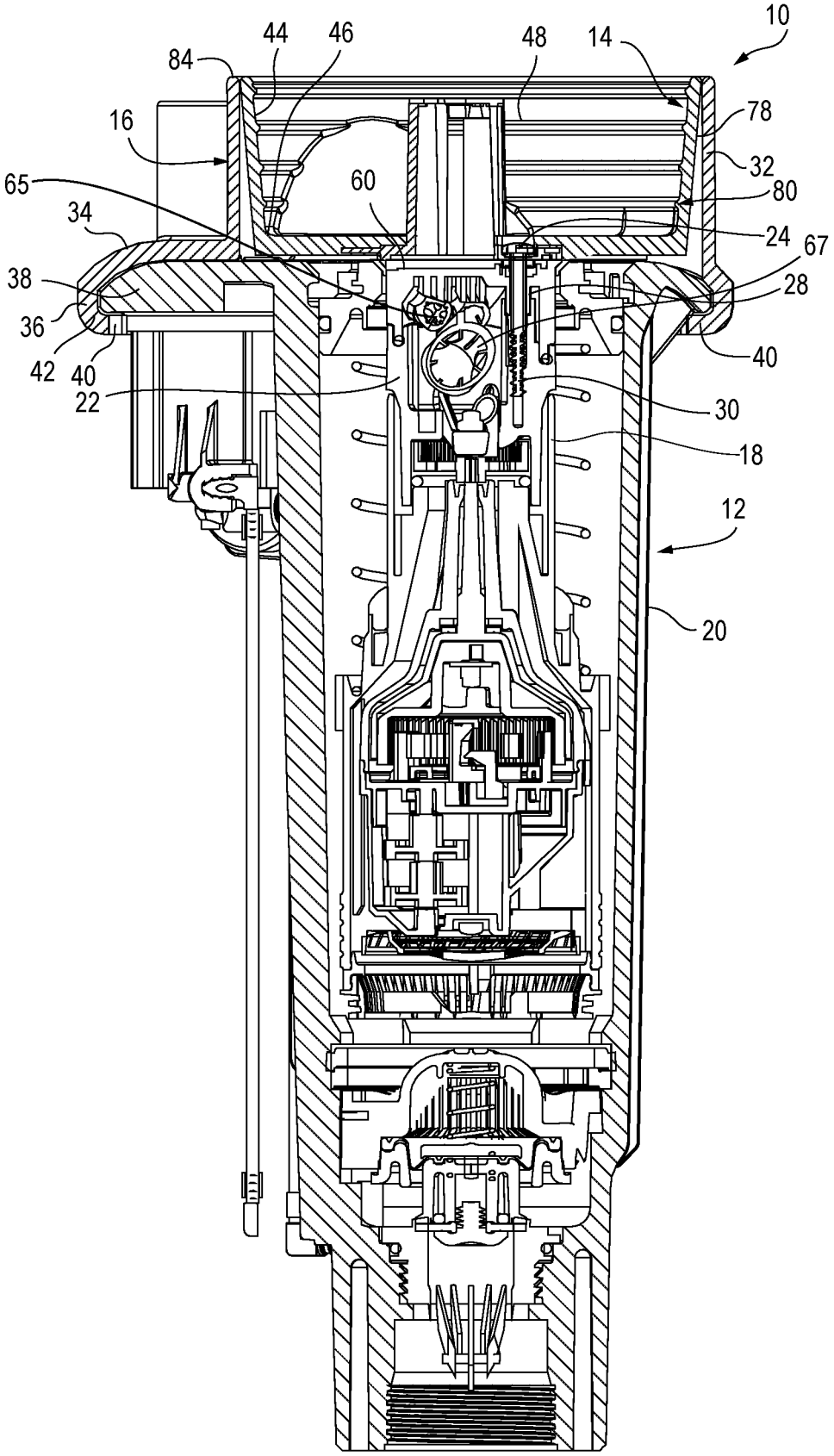
FIG. 2 is a cross-sectional view of the sprinkler and the turf cup assembly of FIG. 1.
Figure 3:
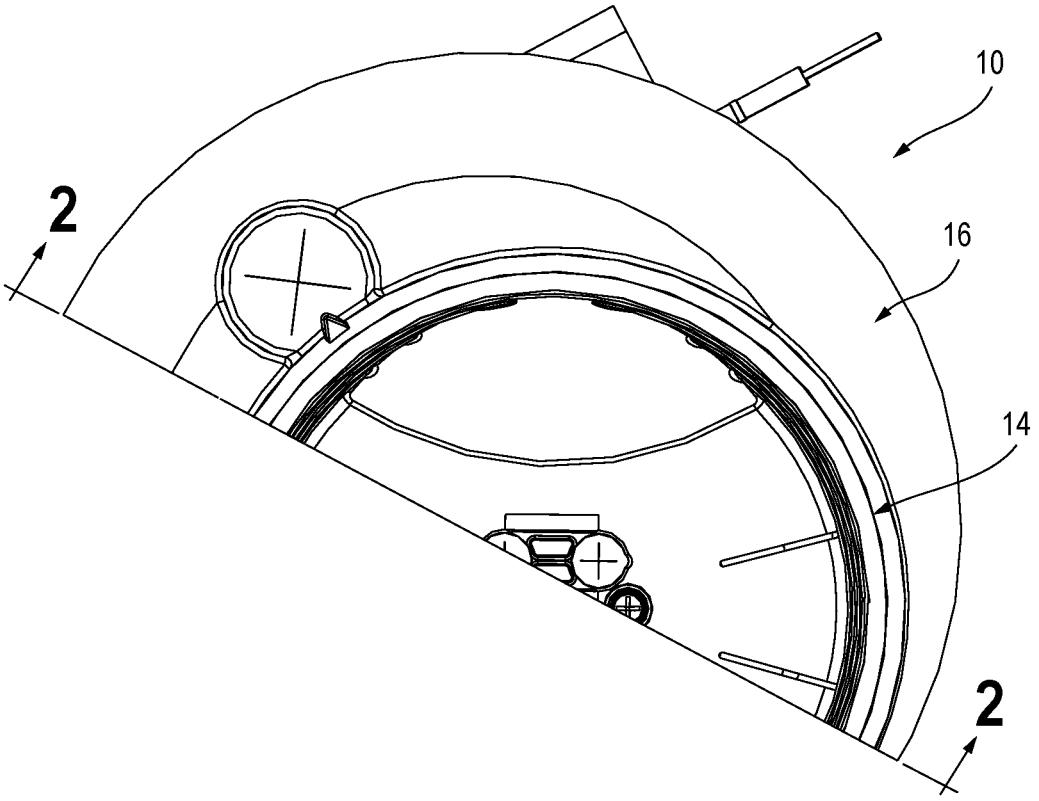
FIG. 3 is a partial, top perspective view of the sprinkler and turf cup assembly of FIG. 1 showing where the cross-section of FIG. 2 is taken along line 2-2.

With reference to FIGS. 1-3, there is illustrated a turf cup assembly 10 attached to a sprinkler 12. The turf cup assembly 10 includes a turf cup 14 and a sleeve 16. The turf cup 14 mounts to a riser 18 of the sprinkler 12, and the sleeve 16 attaches to a housing 20 of the sprinkler 12. The turf cup 14 contains turf that blends into the turf surrounding the sprinkler 12 to disguise and blend the sprinkler 12 in with the landscape. The sleeve 16 protects the surrounding turf from erosion from water emitting from the sprinkler 12 as the riser 16 extends (pops up) from the housing 20 at the initiation of an irrigation cycle and as the riser 16 retracts into the housing 20 during periods between irrigation cycles. The turf cup assembly is made primarily of a rubber material that absorbs contact and, in combination with the turf, blends the sprinkler in with its surroundings both cosmetically and functionally so that the sprinkler's presence reduces impact of those using the turf area.

More specifically, the turf cup assembly 10 can be easily attached to the sprinkler 12. The turf cup 14 attaches to a turret 22 of the riser 18 with a pair of screws 24. Each screw 24 extends through a hole 26 defined by the turf cup 14, a boss 28 formed in the turret 22 and an elongated hole 30 where threads of the screw 24 can bite into a wall of the elongated hole 30. The sleeve 16 includes a generally cylindrical portion 32 and a flange 34 that surrounds the cylindrical portion 32. The flange 34 corresponds generally to a top 36 of the housing 20. The flange 34 includes an arcuate skirt 38 and terminates with a series of arcuate tabs 40. The skirt 38 wraps around an edge 42 of the top 36 of the housing 20, and the series of arcuate tabs 40 reach under the edge 42 of the top 36 of the housing 20 to hold the sleeve 16 onto the housing 20. The sleeve 16 has a snap-fit like engagement between the edge 42 of the top 36 and the series of arcuate tabs 40.

Figure 4:
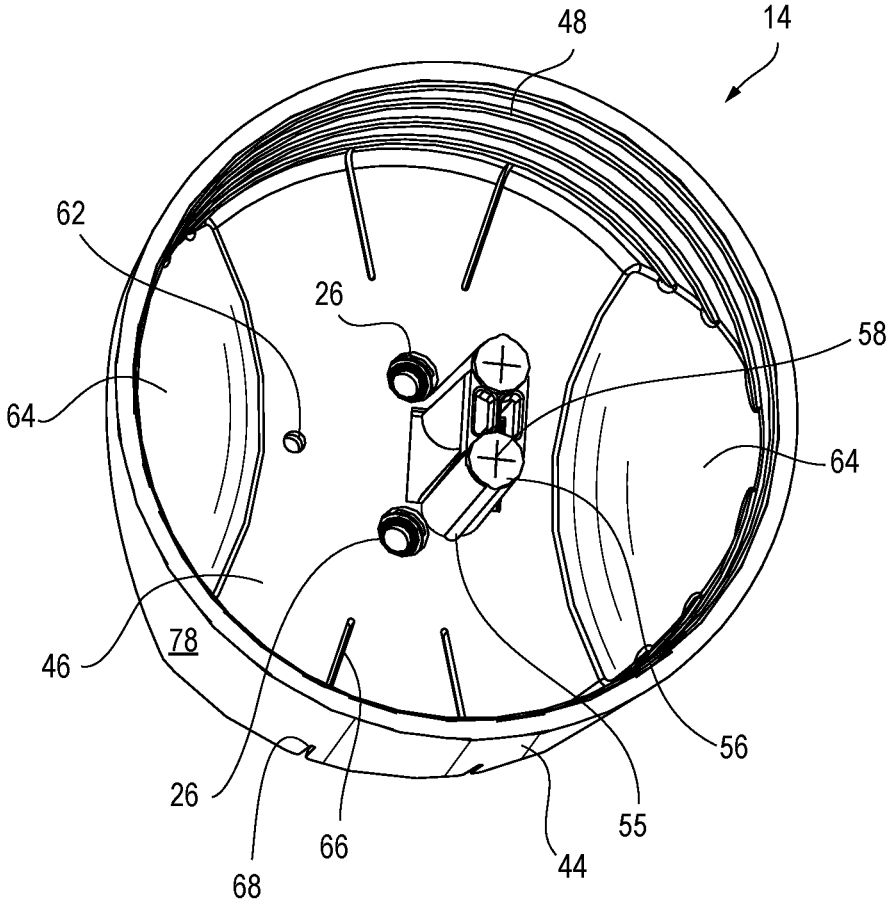
FIG. 4 is a top perspective view of a turf cup of the turf cup assembly of FIG. 1.
Figure 9:
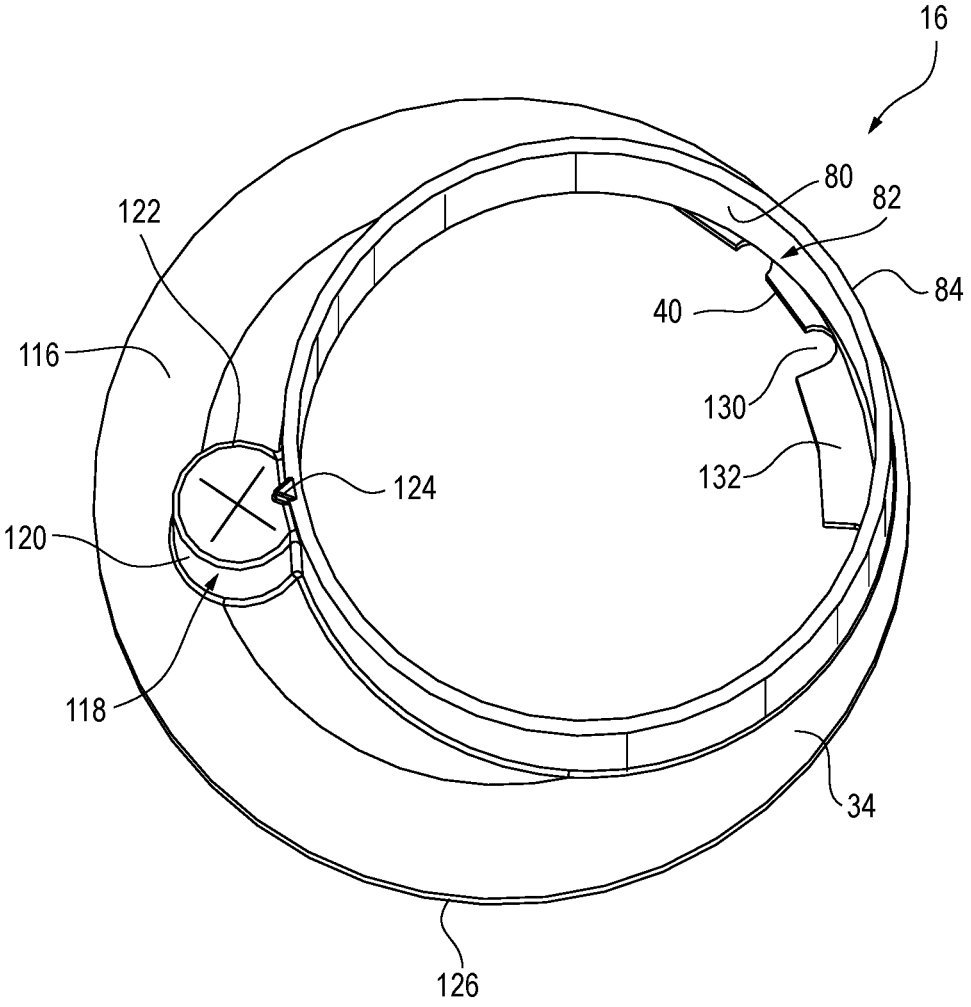
FIG. 9 is a top perspective view of a sleeve of the turf cup assembly of FIG. 1.
Figure 10:
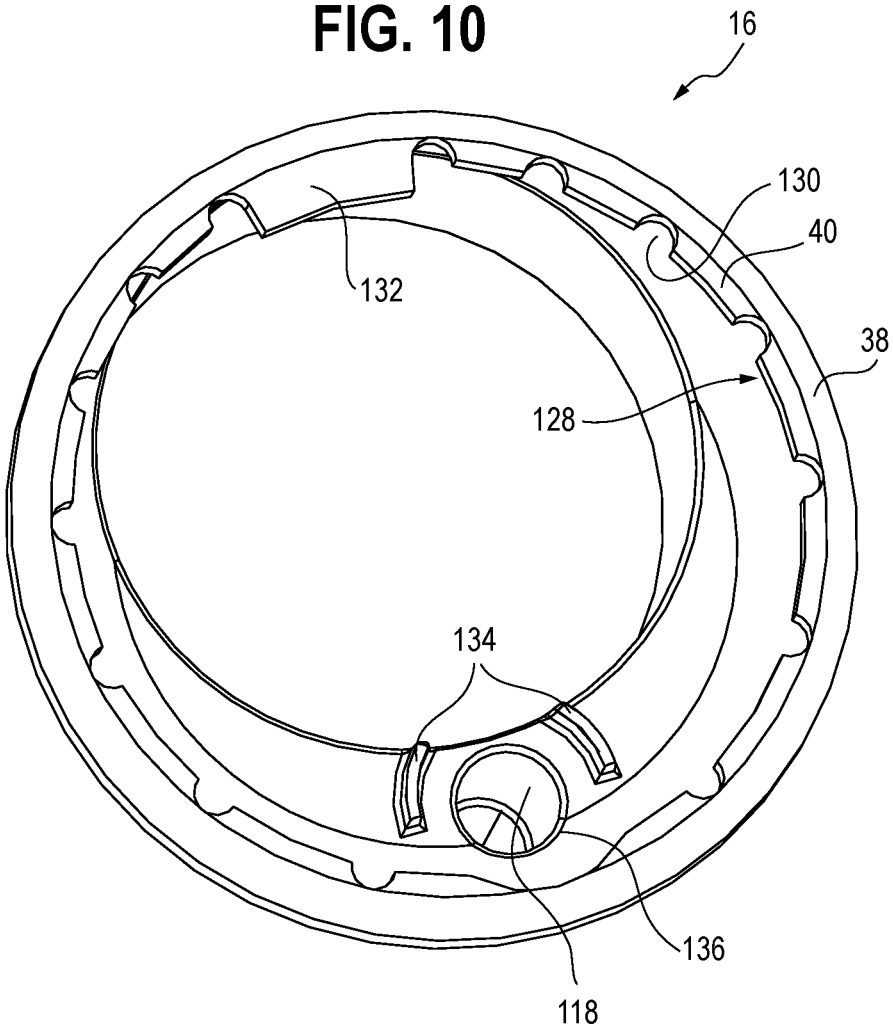
FIG. 10 is a bottom perspective view of the sleeve of FIG. 9.
Figure 11:
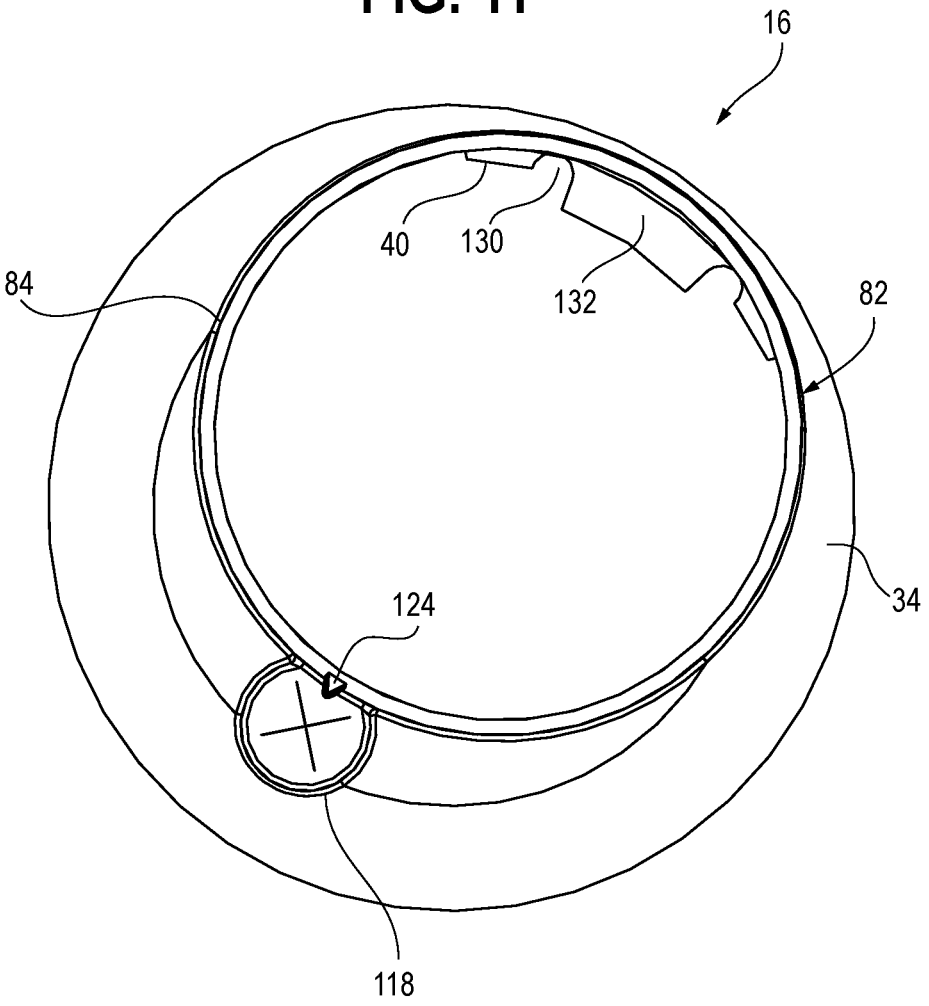
FIG. 11 is a top perspective view of the sleeve of FIG. 9.
Figure 12:
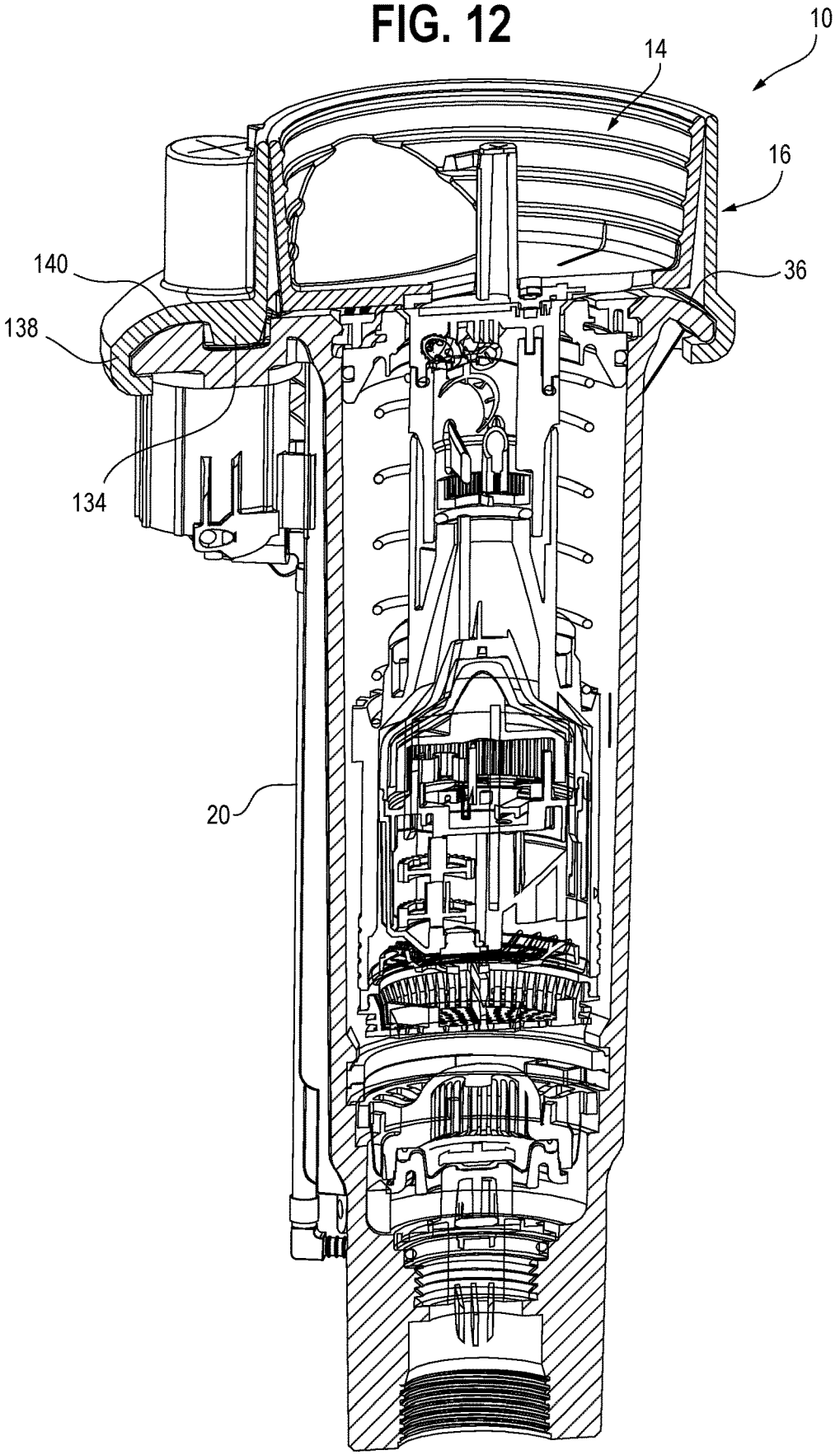
FIG. 12 is a cross-sectional view of the sprinkler and turf cup assembly of FIG. 1.
Figure 13:
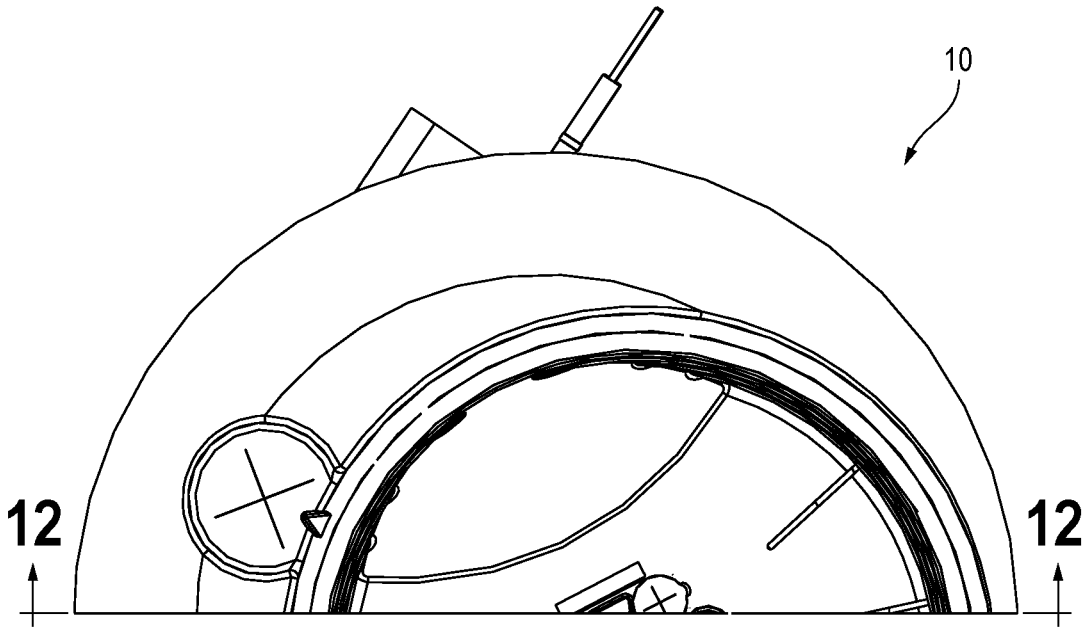
FIG. 13 is a partial, top perspective view of the sprinkler and turf cup assembly of FIG. 1 showing where the cross-section of FIG. 12 is taken along line 12-12.

With reference to FIG. 4, the turf cup 14 has a generally conical wall 44 and bottom 46. The conical wall 44 helps to eliminate stick-ups by providing clearance between an outer surface 78 of the conical wall 44 of the turf cup 14 and an inner surface 80 (FIG. 2) of a cylindrical wall 82 (FIG. 9) forming the cylindrical portion 32 of the sleeve 16 until the bottom 46 of the turf cup 14 has passed an upper lip 84 of the cylindrical portion 32 of the sleeve 16 upon retraction of the riser 18 after an irrigation cycle. This allows surfaces 78,80 to slide and align the turf cup 14 to the center of the cylindrical portion 32 of the sleeve 16 in case the lateral reaction load from the water discharging from the nozzle, manual intervention, or other influence causes the turret 22 to not be centered when the riser 18 retracts.

The conical wall 44 includes a series of annular ribs 48 spaced vertically and that extend into the turf cup 14. The ribs 48 assist in engaging and retaining turf (soil and turf root structure) in the turf cup 14, especially as the turf cup 14 extends and retracts for irrigation cycles. As discussed above, the bottom 46 defines the screw holes 26 for the attachment screws 24. As explained further below, the turf cup 14 includes a support structure 50 (FIG. 7) that includes two elongated tubes 52 that provide access to adjustment screws on the top of the turret 22. These adjustment screws can provide adjustment for the arc range of coverage when in part-circle mode and for switching between part-circle mode and full-circle mode. The elongated tubes 52 can enable these adjustments without removal of turf from the turf cup 14. Alternatively, the turf cup 14 can also be made without the two elongated tubes 52. In such a case, the settings would be made before the turf is installed in the turf cup 14 and adjustments would be made by removing the turf from the turf cup 14.

Extending from the bottom of the turf cup 14 is a pair of tangs 55 each terminating with a cover 56 for each of the elongated tubes 52. The covers 56 have pre-cut or pre-scored lines 58 to allow access of a tool to operate the adjustment screws on a top 60 (FIG. 2) of the turret 22. The tangs 55 are formed during the molding process. A groove 59 (FIG. 7) extends along the sides of the elongated tubes 52 that provides access for the molding material of the turf cup 14 to flow to the top of the elongated tubes 52 to over-mold the covers 56 on the top of the elongated tubes 52.

The bottom 46 of the turf cup 14 also defines a small hole 62 that allows access to a screw that can extend into the water being discharged from the nozzle to disrupt the flow emitting from the nozzle. This enables adjustment of the flow emitting from the nozzle.

The conical wall 44 and the bottom 46 of the turf cup 14 form indentations or relief areas 64. The indentations or relief areas can be angled walls 64 diametrically opposite one another. The angled walls 64 take the form of partial cylinders that are convex from the inside of the turf cup 14 and are concave from outside the turf cup 14. One of the angled walls 64 aligns with a first nozzle 65 of the turret, and the second angled wall 64 aligns with a second nozzle 67 of the turret. The angled walls 64 prevent the turf cup 14 from interfering with the water diverting from the nozzles. This helps enable the sprinkler to maintain distribution uniformity. Without the angled walls 64, the turf cup, such as its bottom, would interfere with water emitting from the nozzles. If the sprinkler only includes a single nozzle, the turf cup would only need one of the indentations, relief areas or angled walls.

The angled walls 64 also allow the turf cup 14 to be larger in size (smaller size may not interfere with water emitting from the sprinkler). This larger size enables the turf cup 14 to match that of common hole plug tools that are used to remove turf plugs for golf holes. The larger size also enables use of larger turf plugs which is believed to make the turf plugs more stable in the turf cup and less likely to be ejected from the turf cup.

The bottom 46 of the turf cup 14 defines a series of radial slots 66 that extend to the conical wall 44 and then continue as generally vertical slots 68 defined by the conical wall 44. The slots 66, 68 provide for drainage of water in the turf cup 14.

Figure 5:
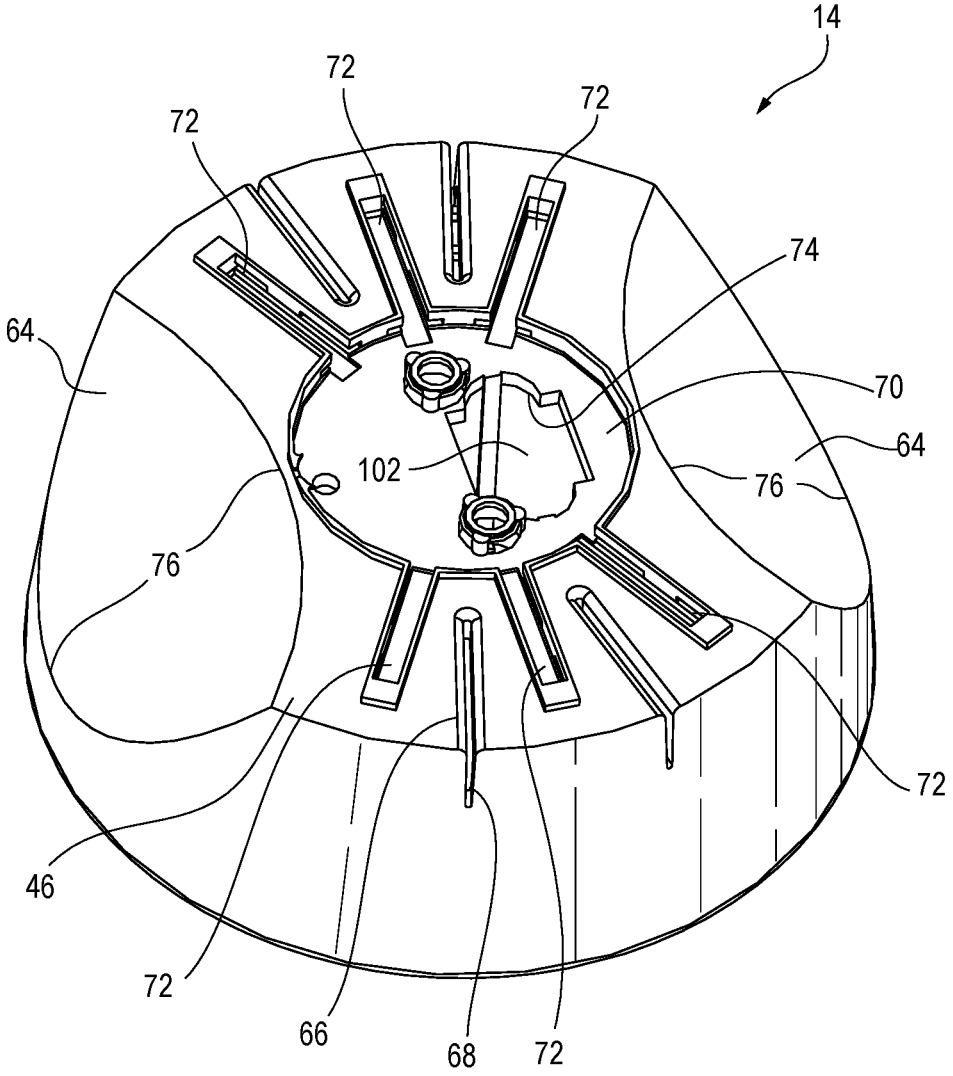
FIG. 5 is a bottom perspective view of the turf cup of FIG. 4 without a support structure.

With reference to FIG. 5, the underside of the turf cup 14 is shown without the support structure 50. The bottom 46 defines a generally circular recess 70 in the center with a series of radial recesses 72 extending from the circular recess 70. The bottom 46 at the radial recesses 72 is over-molded onto the support structure 50 to secure the support structure 50 to the turf cup 14. The circular recess 70 defines an opening 74 for the elongated tubes 52 to extend through from the support structure 50.

As mentioned above, the angled walls 64 are concave walls when viewed from the underneath of the bottom 46 of the turf cup 14. The angled walls 64 each form two angled edges 76 at a transition with the conical wall 44 and the bottom 46 of the turf cup 14.

Figure 6:
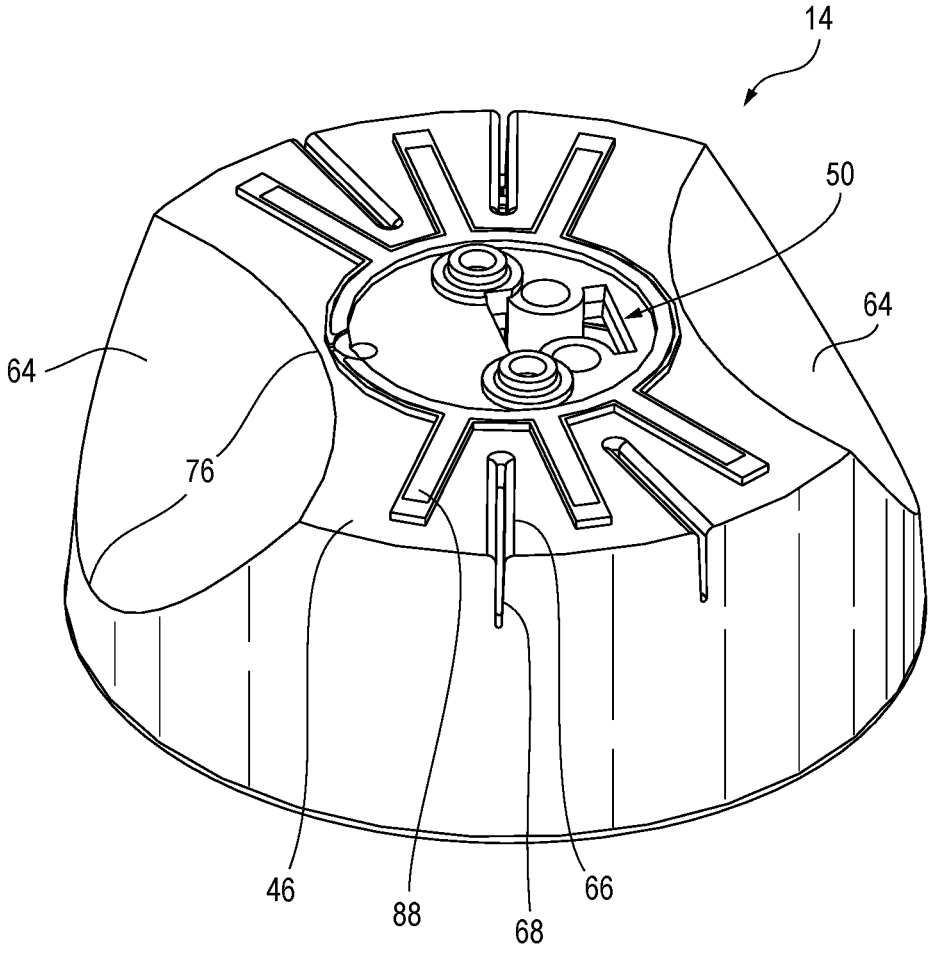
FIG. 6 is a bottom perspective view of the turf cup of the turf cup assembly of FIG. 1.
Figure 7:
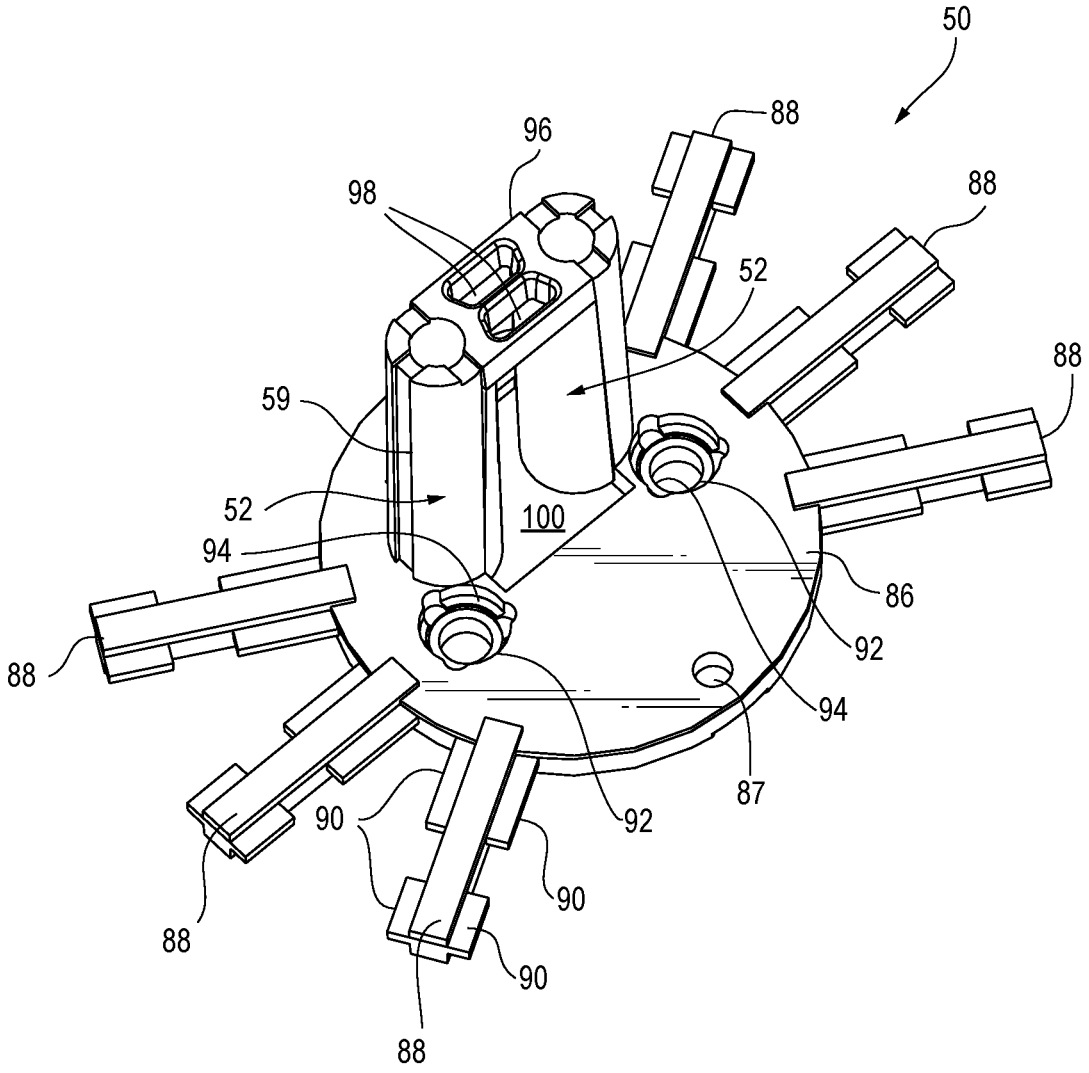
FIG. 7 is a top perspective view of the support structure of the turf cup of FIG. 6.
Figure 8:
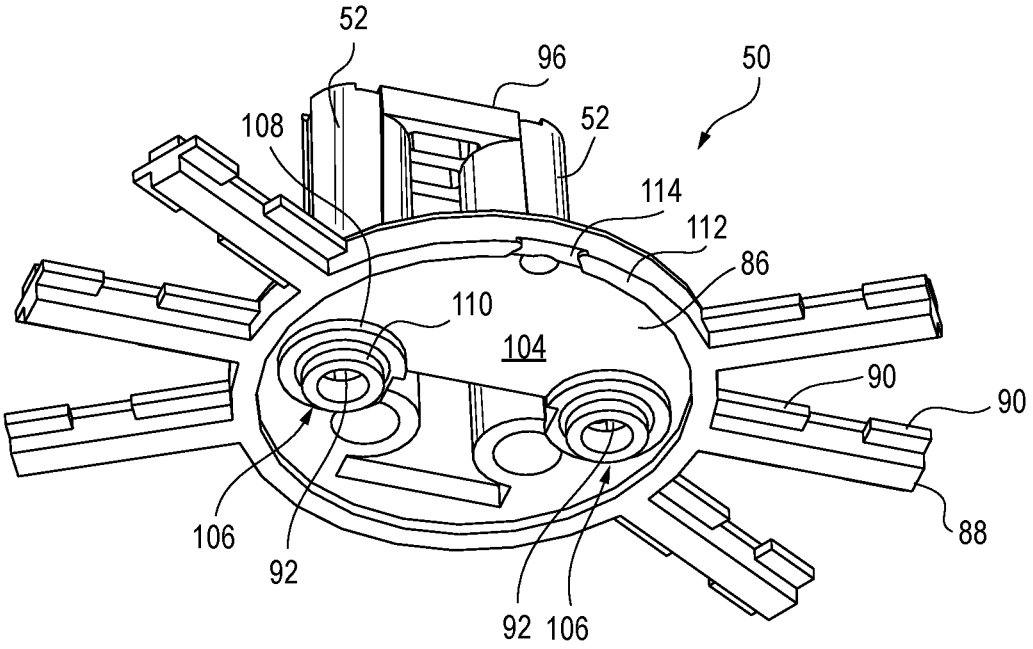
FIG. 8 is a bottom perspective view of the support structure of FIG. 7.

Turning to FIGS. 7 and 8, there is illustrated the support structure 50. The support structure 50 consists of a center disc 86 and a series of spokes 88. The center disc 86 sits in the circular recess 70 of the center of the bottom 46 of the turf cup 14. The spokes 88 sit in the radial recesses 72 of the bottom 46 of the turf cup 14. The spokes 88 include lateral flanges 90 that are over-molded by the material of the bottom 46 of the turf cup 14 to secure the support structure 50 to the turf cup 14. The spokes 88 and the over-molded material along the spokes 88 extend from the bottom 46 of the turf cup 14 (see FIG. 6). The area between the spokes and over-molded material aligns with the drainage slots 66, 68 of the bottom 46 of the turf cup 14.

Alternatively, the support structure 50 can be attached to the bottom 46 of the turf cup 14 using other methods. For example, a snap fit could be used between the support structure 50 and the bottom of the turf cup 14. The snap fit may be between the center disc 86 and the circular recess 70 and/or between the spokes 88 and the radial recesses 72. In one example, the lateral flanges 90 could be fitted into slots formed in the sides of the radial recesses 72. The slots would complement the location, size and length of the lateral flanges. Alternatively, small tabs could project from the bottom surface 46 over the circular recess 70 and/or radial recesses 72. The center disc 86 and the spokes 88 would be pressed into the circular recess 70 and the radial recesses 72 past the small tabs so that the small tabs hold the support structure 50 to the bottom 46 of the turf cup 14. Instead, the support structure 50 could be held in the center recess 70 and/or radial recesses 72 with just a friction fit.

As another alternative, the support structure 50 could be glued with adhesive to the turf cup 14. That is, the support structure 50 could be glued into the circular recess 70 and/or into the radial recesses 72. In another alternative, the support structure 50 could be screwed to the bottom 46 of the turf cup 14. The screws could be used at the center disc 86 and the circular recess 70 and/or at the spokes 88 and the radial recesses 72. As another alternative, the support structure 50 could be welded to the bottom 46 of the turf cup 14 at the center disc 86 and/or the radial spokes 88. With these methods, the support structure 50 could be attached directly to the bottom 46 of the turf cup 14 without using a circular recess 70 and radial recesses 72. For instance, the support structure 50 could be attached to a flat bottom surface of the bottom 46 of the turf cup 14.

The center disc 86 defines a pair of holes 92 for the attachment screws 24 discussed above. The holes 92 have a countersunk portion 94 so that at least a portion of a head of the screws resides in the center disc 86 (see FIG. 2). The holes 92 of the center disc 86 align with the holes 26 of the bottom 46 of the turf cup 14. The elongated tubes 52 extend upwards from the center disc 86 adjacent the holes 92. The elongated tubes 52 are cylindrical and hollow to allow a tool to pass through them to access the adjustment screws on the turret 22. The two elongated tubes 52 are interconnected by a bridge 96 at their terminal ends. The bridge 96 includes a pair of elongated, parallel slots 98. The bridge can be grabbed by hand or with a tool to manually extend the riser 18 from the housing 20. The bridge could also include texture to enhance manual gripping of the bridge.

The center disc 86 defines an opening 100 between the two elongated tubes 52. The opening 100 aligns with an opening 102 (FIG. 5) defined in the bottom 46 of the turf cup 14. This opening 102 in the bottom 46 of the turf cup 14 also allows the elongated tubes 52 to extend through the bottom 46 of the turf cup 14. The center disc 86 further defines another hole 87 that aligns with the hole 62 in the bottom 46 of the turf cup 14 to provide access to the disruption screw for the nozzle.

The bottom 104 of the center disc 86 provides a pair of bosses 106 extending around the holes 92 for the attachment screws 24. The bosses 106 include a stepped configuration where each has a larger portion 108 extending from the bottom 104 of the center disc 86 with a larger outer diameter and a smaller portion 110 extending from the larger portion 108 with a smaller outer diameter. The smaller portion 108 fits into a counter-sunk portion of the screw holes in the top of the turret (FIG. 2) to restrict rotation. The larger portion 110 engages a top 60 of the turret 22 of the riser 18 to space the turf cup 14 from the top 60 of the turret 22. There is no concern of water entering this small dead space. Water can only enter through the elongated tubes 52 or a small gap 114 in an annular ring 112 extending from a perimeter of the bottom 104 of the center disc 86. The annular ring 112 sits on the top 60 of the turret 22. The small gap 114 aids in the molding process by ensuring that the annular ring 112 is formed with constant thickness by not requiring the material to fill-in the entire cavity for the ring during molding. It has been found that without the small gap 114 the thickness of the annular ring 112 may vary.

Referring to FIGS. 9-13, the cylindrical portion 32 of the sleeve 16 is defined by the cylindrical wall 82 from which the turf cup 14 extends during irrigation cycles and in which the turf cup 14 resides between irrigation cycles. The flange 34 extends about the sleeve 16 and has a generally circular perimeter. The cylindrical portion 32 is off center relative to the center of the flange 34. A wider portion 116 of the flange 34 includes an adjustment passageway 118 extending from it. The adjustment passageway 118 permits access to a selector feature for a valve and a solenoid of the sprinkler 12. The adjustment passageway 118 is defined by a generally cylindrical wall 120 and is hollow. The adjustment passageway 118 includes a top 122 that is pre-cut in an "X" configuration to allow insertion of a tool. At the top 122 of the adjustment passage 120 is an alignment indicium, such as an arrow 124, as well as text, such as "OFF", "ON", and "AUTO", to help identify the desired position of the selector feature.

A perimeter 126 of the flange corresponds to a perimeter of a top of the sprinkler housing 20. As mentioned above, the flange 126 includes the arcuate skirt 36 about the perimeter 126. The arcuate skirt 36 wraps around the edge 42 of the top 38 of the housing 20. The skirt 36 terminates with a radially inward extending flange 128 that defines gaps 130 that form the arcuate tabs 40. The arcuate tabs 40 reach under the edge 42 of the top 38 of the housing 20 to hold the sleeve 16 onto the housing 20. The sleeve 16 has a snap-fit like engagement between the edge 42 of the top 38 and the series of arcuate tabs 40. One or more of the arcuate tabs, such as arcuate tab 132 may be larger than the other tabs 40. The larger tab 132 provides a large structure to grab when removing the sleeve 16 from the housing 20 and helps to further secure the sleeve 16 to the housing 20. The gaps 130 are to be aligned with and provide clearance for the support ribs 131 of the housing under the flange 36. Water can drain from between the flange 128 and the bottom the edge 42 of the housing.

On the bottom of the flange 34, a pair of arcuate ribs 134 surround an exit 136 of the adjustment passageway 118. The arcuate ribs 134 extend into an arcuate recess 138 on the top 36 of the housing 20 surrounding the selector feature 140 to align the sleeve 16 on the top 36 of the housing 20.

The material of the support structure 50 is more rigid than that of the turf cup 14 and the sleeve 16. The material for the turf cup 14 and sleeve 16 can be made of ethylene propylene diene monomer. One such material is santoprene. The material for the support structure can be a polypropylene.

Figure 14:
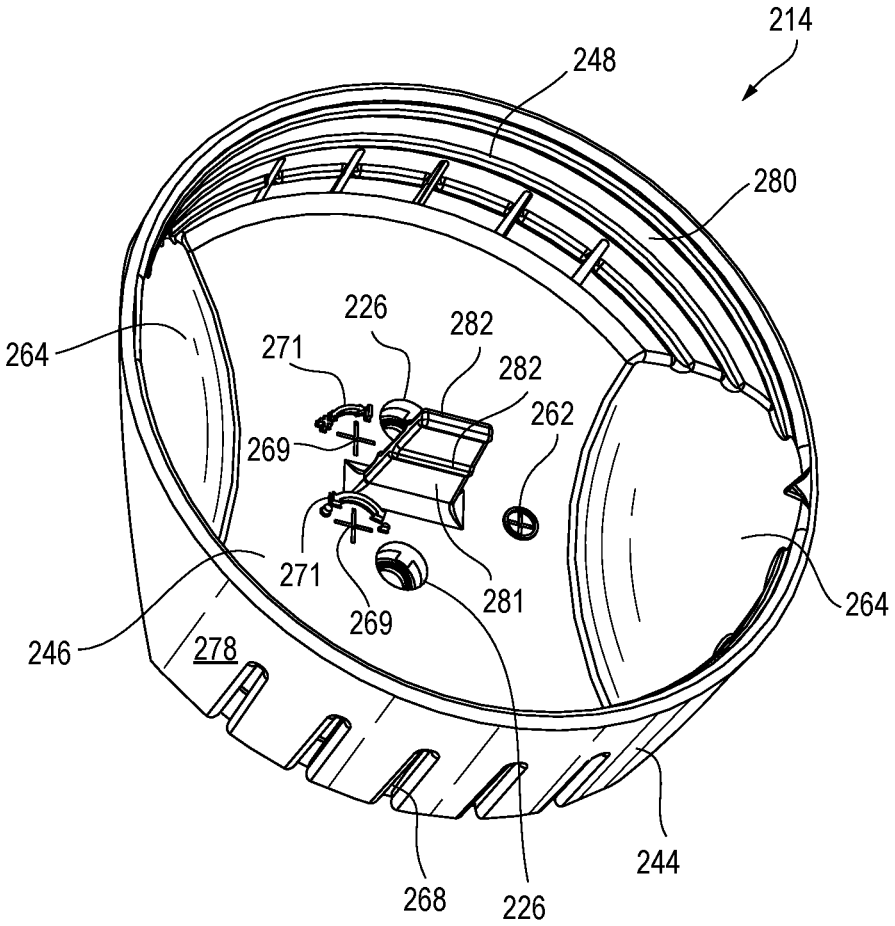
FIG. 14 is a top perspective view of an alternative turf cup.

With reference to FIG. 14, an alternative turf cup 214 is shown. The turf cup 214 may be shaped to be approximately 1.25 inches in depth. The turf cup 214 works with the sleeve 16 of the previous embodiment. The turf cup 214 has a generally conical wall 244 and bottom 246. The conical wall 244 helps to eliminate stick-ups by providing clearance between an outer surface 278 of the conical wall 244 of the turf cup 214 and the inner surface 80 of the cylindrical wall 82 forming the cylindrical portion 32 of the sleeve 16 until the bottom 246 of the turf cup 214 has passed the upper lip 84 of the cylindrical portion 32 of the sleeve 16 upon retraction of the riser 18 after an irrigation cycle. This allows surfaces 278,280 to slide and align the turf cup 214 to the center of the cylindrical portion 32 of the sleeve 16 in case the lateral reaction load from the water discharging from the nozzle, manual intervention, or other influence causes the turret 22 to not be centered when the riser 18 retracts.

The conical wall 244 includes a series of annular ribs 248 spaced apart vertically and that extend radially into the turf cup 214. The ribs 248 assist in engaging and retaining turf (soil and turf root structure) in the turf cup 214, especially as the turf cup 214 extends and retracts for irrigation cycles. The bottom 246 defines screw holes 226 for the attachment screws (such as attachment screws 24). As explained further below, the turf cup 214 includes a support structure 250 (FIGS. 17 and 18) that includes two holes 297 that provide access to adjustment screws on the top of the turret 22. These adjustment screws can provide adjustment for the arc range of coverage when in part-circle mode and for switching between part-circle mode and full-circle mode. More specifically, the turf cup 214 has adjustment passageways 269 that enable the insertion of a tool (e.g., a Phillips Head screwdriver). The adjustment passageways 269 each include a closure that is pre-cut or pre-scored in an "X" configuration to allow insertion of a tool. Initially, if pre-scored, the closures may be unopened. After opening, such as with the head of screw driver, flaps are formed between adjacent, now-separated scores. Those flaps can resiliently deflect to allow insertion of a driver into the adjustment passageways 269, and then can return toward their initial position. Next to each adjustment passage 269 are alignment indicia, such as arrows 271, to help identify the desired position and/or direction of the selector feature.

One can access the passageways 269 through the turf in the turf cup 214. Alternatively, the settings would be made before the turf is installed in the turf cup 214 or adjustments would be made by removing the turf from the turf cup 214.

An adjustment passageway 262 permits access to a screw that can extend into the water being discharged from the nozzle to disrupt the flow emitting from the nozzle. This enables adjustment of the flow emitting from the nozzle. The adjustment passageway 262 includes a closure that is pre-cut in an "X" configuration to allow insertion of a tool (e.g., a Phillips Head screwdriver) in the same manner as described above with respect to the other adjustment passageways 269.

The conical wall 244 and the bottom 246 of the turf cup 214 form angled walls 264 diametrically opposite one another. The angled walls 264 take the form of partial cylinders that are convex from the inside of the turf cup 214 and are concave from outside the turf cup 214. One of the angled walls 264 aligns with a first nozzle of the turret, and the second angled wall 264 aligns with a second nozzle of the turret. The angled walls 264 prevent the turf cup 214 from interfering with the water diverting from the nozzles. This helps enable the sprinkler to maintain distribution uniformity. Without the angled walls 264, the turf cup 214, such as its bottom 246, would interfere with water emitting from the nozzles. If the sprinkler only includes a single nozzle, the turf cup 214 would only need one of the angled walls 264.

The angled walls 264 also allow the turf cup 214 to be larger in size (smaller size may not interfere with water emitting from the sprinkler). This larger size enables the turf cup 214 to match that of common hole plug tools that are used to remove turf plugs for golf holes. The larger size also enables use of larger turf plugs which is believed to make the turf plugs more stable in the turf cup and less likely to be ejected from the turf cup.

The conical wall 244 of the turf cup 214 defines a series of vertical slots 268 that provide for drainage of water in the turf cup 214.

Figure 15:
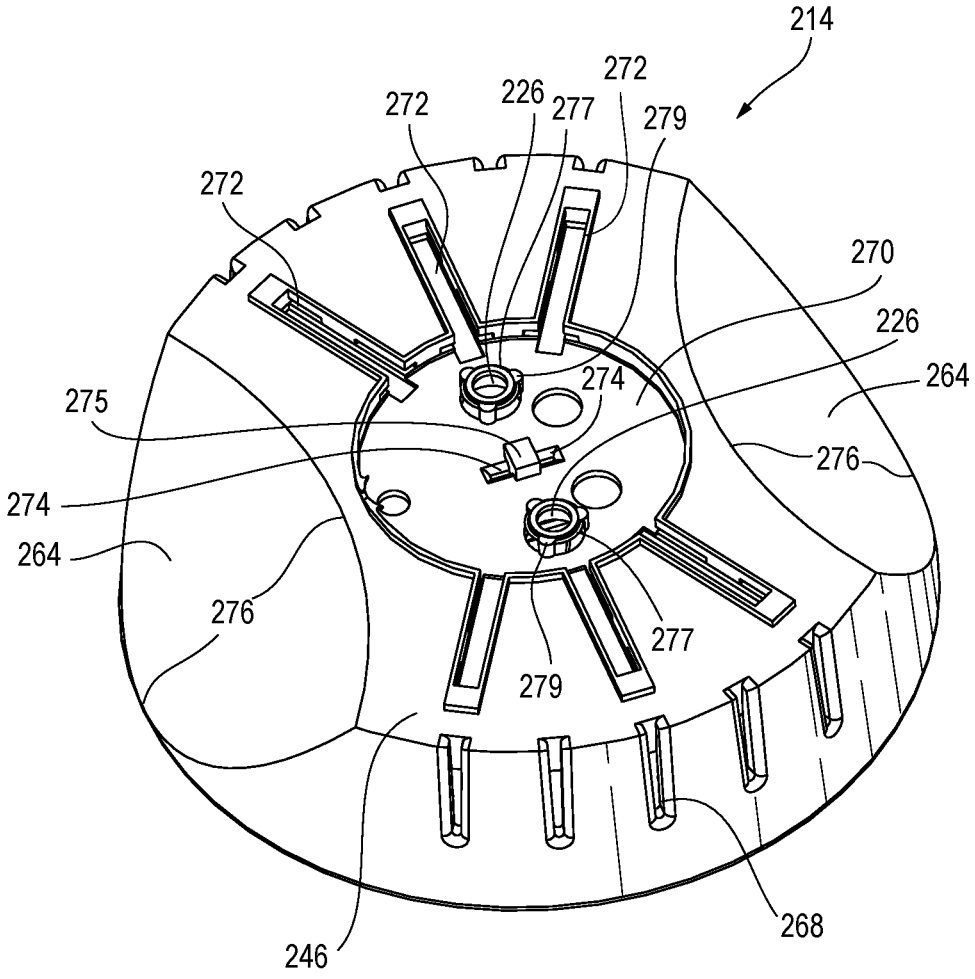
FIG. 15 is a bottom perspective view of the turf cup of FIG. 14 without a support structure.

With reference to FIG. 15, the underside of the turf cup 214 is shown without the support structure 250. The bottom 246 defines a generally circular recess 270 in the center with a series of radial recesses 272 extending from the circular recess 270. The bottom 246 at the radial recesses 272 is over-molded onto the support structure 250 to secure the support structure 250 to the turf cup 214. The circular recess 270 defines a pair of recesses 274 on each side of a rectangular protrusion 275. The circular recess 270 also includes a boss 277 surrounding each of the holes 226. Each boss includes three longitudinally extending ribs 279.

As mentioned above, the angled walls 264 are concave walls when viewed from the underneath of the bottom 246 of the turf cup 214. The angled walls 64 each form two angled edges 276 at a transition with the conical wall 244 and the bottom 246 of the turf cup 214.

Figure 16:
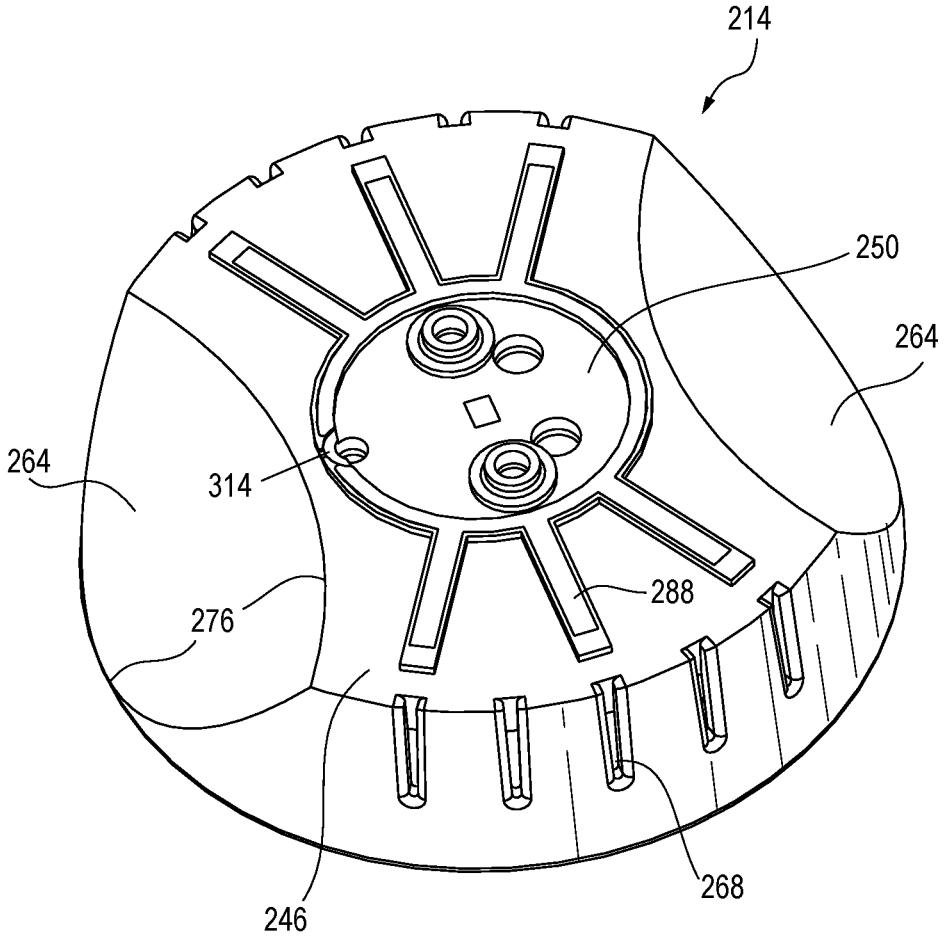
FIG. 16 is a bottom perspective view of the turf cup of FIG. 14.
Figure 17:
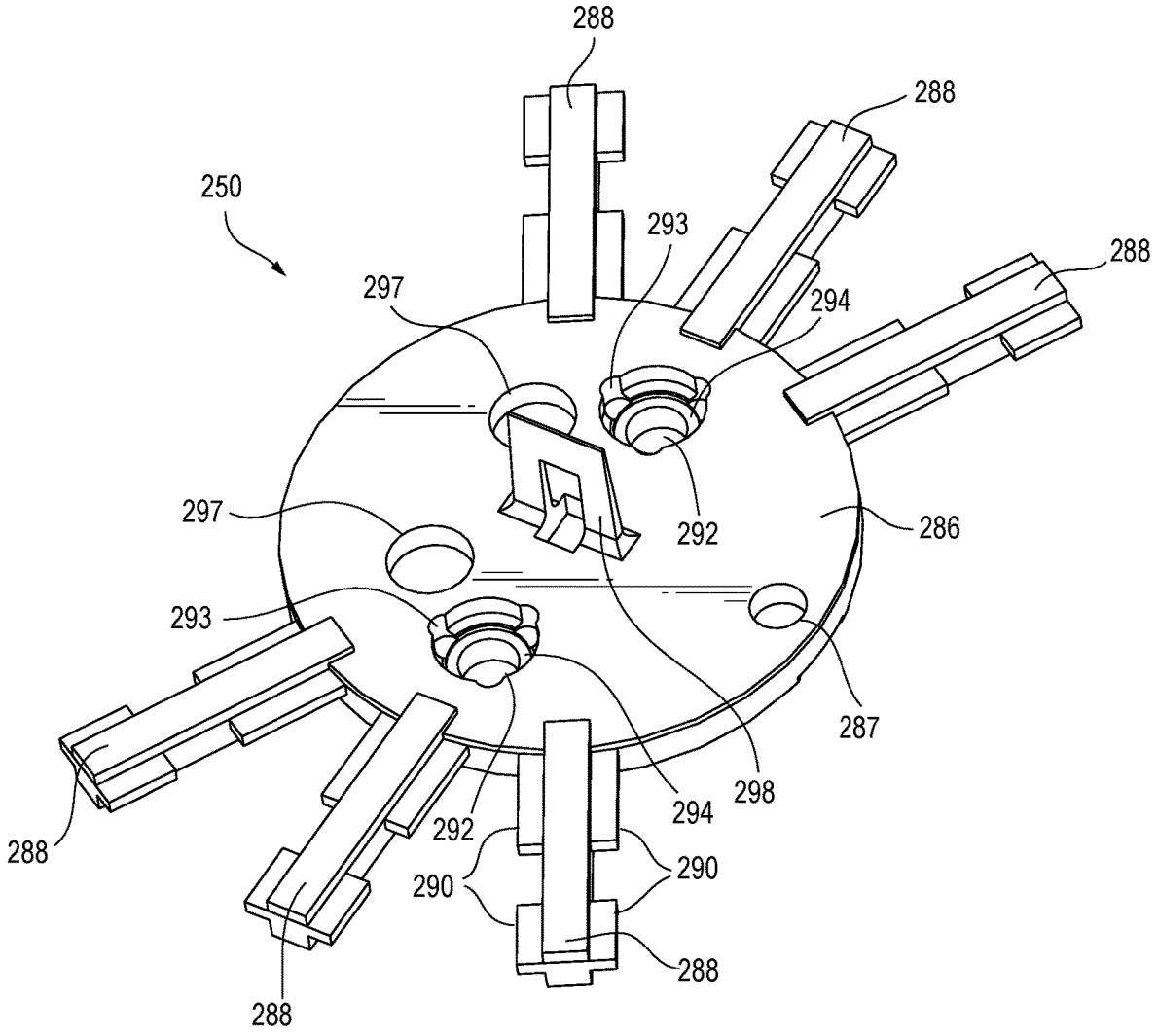
FIG. 17 is a top perspective view of the support structure of the turf cup of FIG. 16.
Figure 18:
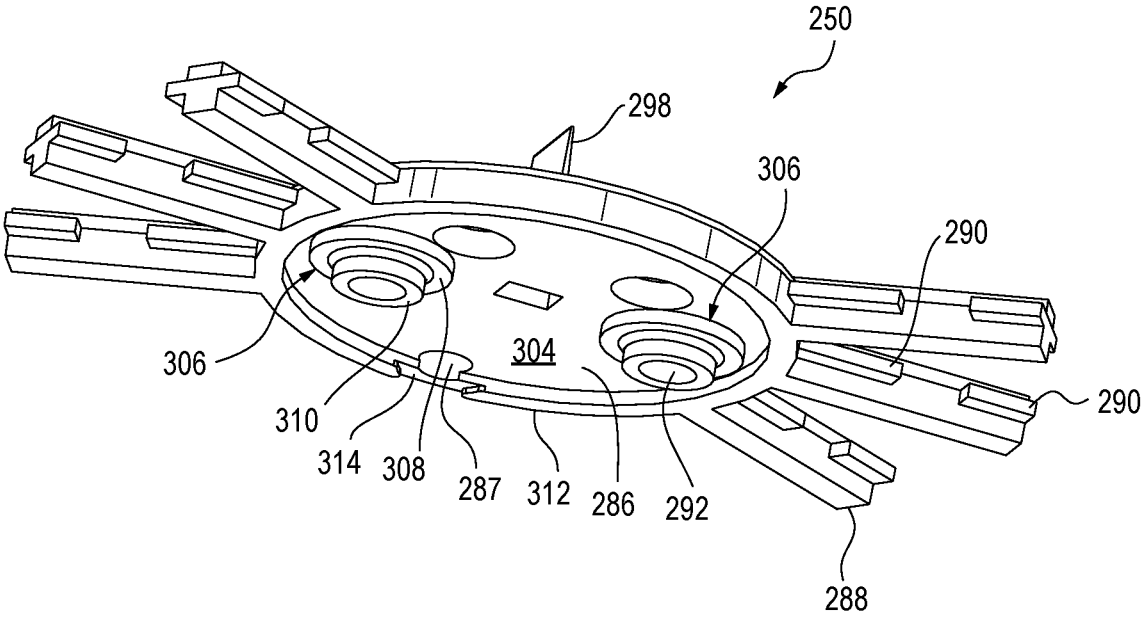
FIG. 18 is a bottom perspective view of the support structure of FIG. 17.

Turning to FIGS. 17 and 18, there is illustrated the alternative support structure 250. The support structure 250 consists of a center disc 286 and a series of spokes 288. The center disc 286 sits in the circular recess 270 of the center of the bottom 246 of the turf cup 214. The spokes 288 sit in the radial recesses 272 of the bottom 246 of the turf cup 214. The spokes 288 include lateral flanges 290 that are over-molded by the material of the bottom 246 of the turf cup 214 to secure the support structure 250 to the turf cup 214. The spokes 288 and the over-molded material along the spokes 288 extend from the bottom 246 of the turf cup 214 (see FIG. 16). The drainage slots 268 align with the spokes 288 and the area between the spokes 288 of the bottom 246 of the turf cup 214.

In addition to over-molding, the support structure 250 could be attached to the bottom 246 of the turf cup 214 using other methods. For example, a snap fit could be used between the support structure 250 and the bottom of the turf cup 214. The snap fit may be between the center disc 286 and the circular recess 270 and/or between the spokes 288 and the radial recesses 272. In one example, the lateral flanges 290 could be fitted into slots formed in the sides of the radial recesses 272. The slots would complement the location, size and length of the lateral flanges. Alternatively, small tabs could project from the bottom surface 246 over the circular recess 270 and/or radial recesses 272. The center disc 286 and the spokes 288 would be pressed into the circular recess 270 and the radial recesses 272 past the small tabs so that the small tabs hold the support structure 250 to the bottom 246 of the turf cup 214. Instead, the support structure 250 could be held in the center recess 270 and/or radial recesses 272 with just a friction fit.

As another alternative, the support structure 250 could be glued with adhesive to the turf cup 214. That is, the support structure 250 could be glued into the circular recess 270 and/or into the radial recesses 272. In another alternative, the support structure 250 could be screwed to the bottom 246 of the turf cup 214. The screws could be used at the center disc 286 and the circular recess 270 and/or at the spokes 288 and the radial recesses 272. As another alternative, the support structure 250 could be welded to the bottom 246 of the turf cup 214 at the center disc 286 and/or the radial spokes 288. With these methods, the support structure 250 could be attached directly to the bottom 246 of the turf cup 214 without using a circular recess 270 and radial recesses 272. For instance, the support structure 250 could be attached to a flat bottom surface of the bottom 246 of the turf cup 214.

The center disc 286 defines a pair of holes 292 for the attachment screws (such as screws 24) discussed above. The holes 292 have a countersunk portion 294 so that at least a portion of a head of the screws resides in the center disc 286 (see FIG. 2). The holes 292 of the center disc 286 align with the holes 226 of the bottom 246 of the turf cup 214. The holes 292 include longitudinal extending grooves 293 that form the ribs 279 on the bosses 277 of the turf cup 214 during over-molding. The center disc 286 further defines another hole 287 that aligns with the hole 262 in the bottom 246 of the turf cup 214 to provide access to the disruption screw for the nozzle.

The turf cup 214 includes a pull tab 298 for engaging to extend the riser 18 from the housing 20. The pull tab 298 extends upwards from the center disc 286 between the holes 292 and a cover 281 (see FIG. 14) that is over-molded onto the pull tab 298. More specifically, the cover 281 extends up from center of the bottom 246 of the turf cup 214 and surrounds the pull tab 298. The cover 281 has ledges 282 that can be grabbed by hand or with a tool, such as a pliers, to manually extend the riser 18 from the housing 20. Each side of the cover 281 could have any number of ledges and the ledges could be staggered so that they do not align with each other from side-to-side. Alternatively, the cover could be slightly larger than the support structure or capable of stretching so that the support structure could be inserted into the cover to accommodate the alternative attachment methods described above for attaching the support structure 250 to the turf cup 214.

The material of the support structure 250 is more rigid than that of the turf cup 214. Therefore, the pull tab 297 of the support structure 250 is more rigid than the cover 281 of the turf cup 214. The rigidity of the pull tab 298 provides support for the cover 281 when the cover 281 is grabbed by hand or by a tool for extending the riser 18 from the housing 20.

The material for the support structure can be a polypropylene. The material for the turf cup 214 can be made of ethylene propylene diene monomer. One such material is santoprene.

A bottom 304 of the center disc 286 has a pair of bosses 306 extending around the holes 292 for the attachment screws 24. The bosses 306 include a stepped configuration where each has a larger portion 308 extending from the bottom 304 of the center disc 286 with a larger outer diameter and a smaller portion 310 extending from the larger portion 308 with a smaller outer diameter. The smaller portion 310 fits into the counter-sunk portion of the screw holes in the top of the turret (FIG. 2) to restrict rotation. The larger portion 308 engages the top 60 of the turret 22 of the riser 18 and is on the same plane as annular ring 312 extending from a perimeter of the bottom 304 of the center disc 286 to space the turf cup 214 from the top 60 of the turret 22. There is no concern of water entering this small dead space. Water can only enter through the holes 269 and 262 (once their cover has been pierced) or a small gap 314 in the annular ring 312 extending from a perimeter of the bottom 304 of the center disc 286. The annular ring 312 sits on the top 60 of the turret 22. The small gap 314 aids in the molding process by ensuring that the annular ring 312 is formed with constant thickness by not requiring the material to fill-in the entire cavity for the ring during molding. It has been found that without the small gap 312 the thickness of the annular ring 312 may vary.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the technological contribution. The actual scope of the protection sought is intended to be defined in the following claims.

What is claimed is:

1. A turf cup assembly for a pop-up sprinkler comprising:

a turf cup for holding a turf structure and being capable of attachment to a riser of a pop-up sprinkler;

a sleeve surrounding the turf cup;

a flange extending from the sleeve, the flange having a perimeter that extends underneath a top of a housing of the pop-up sprinkler to attach the sleeve to the housing.

2. The turf cup assembly of claim 1 wherein the sleeve and the turf cup are disposed off-center relative to a perimeter of the flange.

3. The turf cup assembly of claim 1 wherein the turf cup includes a wall with at least one indentation to aid in distribution uniformity of water being emitted from a pop-up sprinkler.

4. The turf assembly of claim 3 wherein in the at least one indentation aligns with a nozzle of a pop-up assemble to aid in distribution uniformity of water being emitted from a pop-up sprinkler.

5. The turf cup assembly of claim 1 wherein the turf cup includes a sidewall defining drainage slots.

6. The turf cup assembly of claim 1 wherein the turf cup includes a bottom and tubes extending upward relative to the bottom for access to a top of a sprinkler.

7. The turf cup assembly of claim 1 wherein the turf cup includes a support structure including a base and at least two extensions from the base.

8. The turf cup assembly of claim 7 wherein at least a portion of the turf cup is over-molded onto to at least a portion of the support structure.

9. The turf cup assembly of claim 8 wherein the support structure includes a portion supported in the turf cup that can be pulled to manually raise a riser from a housing of a pop-up sprinkler.

10. The turf cup assembly of claim 1 wherein the sleeve further comprises a tube extending upward from the flange.

11. The turf cup assembly of claim 1 wherein the sleeve further comprises at least one protrusion that orients the sleeve relative to the pop-up sprinkler.

12. The turf cup assembly of claim 1 wherein the perimeter of the flange includes tabs separated by gaps.

13. The turf cup assembly of claim 12 wherein at least one tab is larger than another tab.

* * * * *